US006451075B1

(12) United States Patent
Schoppe et al.

(10) Patent No.: US 6,451,075 B1
(45) Date of Patent: Sep. 17, 2002

(54) LOW LEAD AVIATION GASOLINE BLEND

(75) Inventors: Robert A. Schoppe, Houston; James Drew Laughlin, Kingswood, both of TX (US)

(73) Assignee: Texas Petrochemicals LP, Houston, TX (US)

( * ) Notice: Subject to any disclaimer, the term of this patent is extended or adjusted under 35 U.S.C. 154(b) by 0 days.

(21) Appl. No.: 09/457,920

(22) Filed: Dec. 9, 1999

(51) Int. Cl.[7] ..... C10L 1/04; C10L 1/30

(52) U.S. Cl. ..... 44/454; 44/447; 44/448; 585/14

(58) Field of Search ..... 44/447, 448, 454; 585/14; 208/15

(56) References Cited

U.S. PATENT DOCUMENTS 4,812,146 A * 3/1989 Jessup ..... 44/447
5,277,881 A * 1/1994 Partridge ..... 422/241
6,187,064 B1 * 2/2001 Henderson ..... 44/359

FOREIGN PATENT DOCUMENTS

WO 9822556 * 5/1998

OTHER PUBLICATIONS

Emel'yanov, V.E Et Al, Methy Tert–butyl Ether as a Component of Aviation Gasolines. Khim. Tekhnol. Topl. Masel(1991), 9, 12–13.*

* cited by examiner

*Primary Examiner*—Cephia D. Toomer
(74) *Attorney, Agent, or Firm*—James H. Marsh, Jr.; Stinson Morrison Hecker LLP

(57) ABSTRACT

A particularly useful low lead aviation gasoline fuel blend complies with all requirements of ASTM D 910 and includes 67.0 volume % isooctane, 18.0 volume % xylene, 12.0 volume % isopentane, 3.0 volume % isobutane and 0.47 mL/gal of tetraethyl lead. Another useful low lead aviation gasoline fuel blend which complies with all requirements of ASTM D 910 except for oxygenate content includes 60.0 volume % isooctane, 15.0 volume % xylene, 14.0 volume % methyl t-butyl ether, 8.0 volume % isopentane, 3.0 volume % isobutane and 0.2 mL/gal of tetraethyl lead. The isooctane used in either case is a purified isooctane prepared either by fractionating a crude DIB material and hydrogenating the fractionated material or hydrogenating the crude DIB material and fractionating the hydrogenated material.

52 Claims, No Drawings

LOW LEAD AVIATION GASOLINE BLEND

BACKGROUND OF THE INVENTION

1. Field of the Invention

The present invention relates to a reduced or low lead aviation gasoline blend which satisfies the requirements of ASTM D 910 or deviates therefrom only in the inclusion of an oxygenate. In particular the invention relates to such an aviation gasoline blend which comprises at least about 50% by volume 2,2,4-trimethylpentane and contains less than the maximum of 0.53 mL/L of lead specified by ASTM D 910.

2. The Prior Art Background

Tetraethyl lead (TEL) was used for years to increase octane in both automotive and aviation gasoline fuels. On Jan. 1, 1996 TEL was banned from use in automotive gasoline fuels by the EPA Clean Air Act. The General Aviation industry is concerned that these criteria will be extrapolated to aviation gasoline fuels so as to increase the cost and affect the reliability and/or consistency thereof. This concern is exacerbated because aviation gasoline fuel generally must have a higher octane than automotive fuel. Moreover, consumers in the general aviation industry require a gasoline fuel product which has a consistent and reliable octane rating so as to provide an appropriate consistent performance level.

Generally speaking, aviation gasoline fuels today must meet the requirements of ASTM D 910 (1996). Presently relevant criteria of ASTM D 910 are set forth below in TABLE 1.

TABLE 1

| | | |
|---|---|---|
| D 5191 | Vapor pressure | 38.0–49.0 kPa |
| D 3338 | Heat of combustion, net | 43.5 MJ/kg min |
| D 5059 | Lead content | 0.53 mL/L max |
| D 2700 | Motor octane number (MON) (BRE/30.2in/300F) | 99.5 min |
| D 909 | ASTM Supercharge rating (1.31 mL TEL/gal) Performance number | 130.0 min |
| D 86 | Distillation, ° C., % evaporated | |
| | 10% | 75 max |
| | 40% | 75 min |
| | 50% | 105 max |
| | 90% | 135 max |
| | Final boiling point | 170 max |
| | Sum of 10% + 50% evaporated | 135 min |
| | Recovery | 97% min |
| | Residue | 1.5% max |
| | Loss | 1.5% max |

ASTM D 910 also excludes oxygenates. To meet the criteria of ASTM D 910, most aviation gasoline fuels today comprise a blend containing about 70 volume % alkylate, about 10 volume % isopentane and about 20 volume % toluene. Approximately 2 gm of TEL is added to each gallon of the blend to appropriately increase the MON to the specified level. This is the maximum amount of lead allowed by the ASTM D 910 specification. The very stringent specifications set by ASTM D 910 (1996) for aviation gasoline fuels, particularly the supercharge octane rating, the MON, the vapor pressure and the distillation criteria greatly reduce the options available to blend a satisfactory aviation gasoline fuel without using a lead additive to increase the octane level. In fact most prior art aviation gasoline fuel blends have necessarily included the maximum amount of lead permitted.

The ASTM D 910 (1996) specification sets only a maximum level for lead. Accordingly, aviation gasoline with no lead would be suitable assuming all other criteria are met. At this point in time the EPA is adamant about reducing or eliminating lead in aviation gasoline and it is believed that the main reason that the EPA has not yet moved on this point is that there currently is no solution to the problem of achieving high enough octane in aviation gasoline fuels without using lead. Were the EPA to move now, it might lead to the destruction of the entire general aviation industry.

So a major unsolved problem in the general aviation industry today is how to provide an aviation gasoline fuel which meets all of the criteria of the ASTM D 910 (1996) specification without using lead as an additive. Stated another way, the problem is how to reduce or eliminate the need for lead in aviation gasoline fuels.

SUMMARY OF THE INVENTION

The present invention provides a genuine solution to the problems discussed above. Thus, the invention provides a reduced lead aviation gasoline blend which satisfies the requirements of ASTM D 910. In particular, the invention provides an aviation gasoline fuel that comprises at least about 50.0 volume % 2,2,4-trimethylpentane (sometimes referred to simply as "isooctane"), whereby the lead content of the fuel may be reduced to less than 0.53 mL/L. Thus, the fuel of the invention may comprise at least about 50.0 volume % 2,2,4-trimethylpentane, meets the requirements of ASTM D 910, and contains less than 0.53 mL/L lead.

More particularly, the invention provides a gasoline blend which is suitable for use in an internal combustion airplane engine and which contains no more than 0.26 mL/L of lead and which may comprise from about 55.0 to about 65.0 volume % of 2,2,4-trimethylpentane. Preferably the gasoline blend of the invention may comprise from about 58.0 to about 62.0 volume % of the 2,2,4-trimethylpentane. More preferably the gasoline blend of the invention may comprise about 60.0 volume % of the 2,2,4-trimethylpentane. Ideally, the gasoline blend of the invention may comprise no more than about 85.0 volume % of the 2,2,4-trimethylpentane.

Through the use of the invention, the lead content of the gasoline blend may be reduced from the maximum allowed by ASTM D 910 to an amount which ranges from about 0.11 to about 0.15 mL/L. Preferably, and in accordance with one aspect of the invention, the lead content may range from about 0.12 to about 0.14 mL/L. Ideally, in accordance with this aspect of the invention, the lead content of the fuel may be about 0.13 mL/L. In fact, the lead content of the aviation fuel may be reduced to an amount which is no more than about 0.13 mL/L.

Through the use of another aspect of the invention, wherein the gasoline blend includes an oxygenate, the lead content of the gasoline blend may be reduced from the maximum allowed by ASTM D 910 to an amount which ranges from about 0.03 to about 0.07 mL/L. Preferably, in accordance with this aspect of the invention, the lead content may range from about 0.04 to about 0.06 mL/L. Ideally, in accordance with this aspect of the invention, the lead content of the fuel may be about 0.05 mL/L. In fact, the lead content of the aviation fuel may be reduced to an amount which is no more than about 0.05 mL/L.

A predominant feature of the invention is the use of a major amount of 2,2,4-trimethylpentane in the gasoline blend. As mentioned above, the content of this ingredient in the overall gasoline blend may be as low as 50.0% and as high as 85.0% by volume. Preferably, the blend may contain about 60.0 volume % of the 2,2,4-trimethylpentane. In accordance with another aspect of the invention the gasoline blend may contain about 67.0 volume % of said 2,2,4-trimethylpentane.

The aviation gasoline blend of the invention may also include a $C_7$–$C_{11}$ aromatic hydrocarbon, a $C_5$–$C_6$ aliphatic hydrocarbon and a $C_4$ aliphatic hydrocarbon. Preferably the blend may contain a sufficient amount of a $C_7$–$C_{11}$ aromatic hydrocarbon to provide an appropriate supercharge rating. Furthermore, the blend may include a sufficient amount of a $C_5$–$C_6$ aliphatic hydrocarbon to provide D-86 distillation control. Additionally, the blend may include a sufficient amount of a $C_4$ aliphatic hydrocarbon to provide D-86 distillation and RVP control.

In one highly preferred embodiment of the invention, the aviation gasoline blend may comprise from about 56.0 to about 64.0 volume % 2,2,4-trimethylpentane, from about 13.0 to about 17.0 volume % xylene, from about 12.0 to about 16.0 volume % methyl t-butyl ether, from about 6.5 to about 9.5 volume % isopentane, from about 2.0 to about 4.0 volume % isobutane and no more than about 0.1 mL/L tetraethyl lead. More preferably, the aviation gasoline blend of the invention may comprise from about 58.0 to about 62.0 volume % 2,2,4-trimethylpentane, from about 14.0 to about 16.0 volume % xylene, from about 13.0 to about 15.0 volume % methyl t-butyl ether, from about 7.0 to about 9.0 volume % isopentane, from about 2.5 to about 3.5 volume % isobutane and no more than about 0.07 mL/L tetraethyl lead. Ideally the blend may include about 60.0 volume % 2,2,4-trimethylpentane, about 15.0 volume % xylene, about 14.0 volume % methyl t-butyl ether, about 8.0 volume % isopentane, about 3.0 volume % isobutane and no more than about 0.05 mL/L tetraethyl lead.

In another highly preferred embodiment of the invention, the aviation gasoline blend may comprise from about 62.0 to about 72.0 volume % 2,2,4-trimethylpentane, from about 15.0 to about 21.0 volume % xylene, from about 10.0 to about 14.0 volume % isopentane, from about 2.0 to about 4.0 volume % isobutane and no more than about 0.20 mL/L tetraethyl lead. More preferably, the aviation gasoline blend of this embodiment may comprise from about 64.0 to about 70.0 volume % 2,2,4-trimethylpentane, from about 16.0 to about 20.0 volume % xylene, from about 10.5 to about 13.5 volume % isopentane, from about 2.5 to about 3.5 volume % isobutane and no more than about 0.20 mL/L tetraethyl lead. Ideally, the blend of this embodiment may include about 67.0 volume % 2,2,4-trimethylpentane, about 18.0 volume % xylene, about 12.0 volume % isopentane, about 3.0 volume % isobutane and no more than about 0.13 mL/L tetraethyl lead.

In a broader sense, and in one preferred aspect of the invention, the aviation gasoline blend of the invention may include from about 56.0 to about 64.0, more preferably from about 58.0 to about 62.0 and ideally about 60.0 volume % 2,2,4-trimethylpentane, from about 13.0 to about 17.0, more preferably from about 14.0 to about 16.0 and ideally about 15.0 volume % of a $C_7$–$C_{11}$ aromatic hydrocarbon, from about 12.0 to about 16.0, more preferably from about 13.0 to about 15.0 and ideally about 14.0 volume % of an oxygenate, from about 6.0 to about 10.0, more preferably from about 7.0 to about 9.0 and ideally about 8.0 volume % of a branched aliphatic $C_5$–$C_6$ hydrocarbon, from about 2.0 to about 4.0, more preferably from about 2.5 to about 3.5 and ideally about 3.0 volume % of a branched $C_4$ aliphatic hydrocarbon and no more than about 0.1 mL/L tetraethyl lead.

In another preferred aspect of the broader invention, the aviation gasoline blend of the invention may include from about 63.0 to about 70.0, more preferably from about 65.0 to about 69.0 and ideally about 67.0 volume % 2,2,4-trimethylpentane, from about 15.0 to about 21.0, more preferably from about 16.5 to about 19.5 and ideally about 17.0 volume % of a $C_7$–$C_{11}$ aromatic hydrocarbon, from about 10.0 to about 14.0, more preferably from about 11 to about 13 and ideally about 12 volume % of a branched aliphatic $C_5$–$C_6$ hydrocarbon, from about 2.0 to about 4.0, more preferably from about 2.5 to about 3.5 and ideally about 3.0 volume % of a branched $C_4$ aliphatic hydrocarbon and no more than about 0.2 mL/L tetraethyl lead.

In a larger, broader sense, the invention provides an aviation gasoline blend which satisfies the requirements of ASTM D 910, contains no more than 0.26 mL/L of lead and comprises a sufficient amount of 2,2,4-trimethylpentane to provide the blend with a motor octane number of at least 99.5.

DETAILED DESCRIPTION OF THE PREFERRED EMBODIMENTS

The invention provides an aviation gasoline fuel blend which includes a reduced amount of lead and still complies with all of the criteria set by the ASTM D 910 specification for aviation fuel. These criteria of ASTM D 910 are set forth above in TABLE 1. In accordance with the invention, the principal component of the aviation gasoline of the invention is 2,2,4-trimethylpentane, a $C_8$ branched chain aliphatic hydrocarbon that is sometimes referred to as isooctane. Preferably the isooctane is present in the fuel of the invention in an amount which is at least 50.0 volume % of the entire blend. Isooctane may be present in any amount up to and including about 85.0 volume % . When isooctane is present in an amount less than about 50% by volume, the octane will generally be too low. When the amount of isooctane exceeds 85.0% , the vapor pressure will be to low and the distillation profile will not meet the ASTM D 910 criteria.

In one preferred embodiment, the aviation gasoline blend of the invention may desirably include from about 62.0 to about 72.0 volume % 2,2,4-trimethylpentane, from about 15.0 to about 21.0 volume % of a $C_7$–$C_{11}$ aromatic hydrocarbon, from about 10.0 to about 14.0 volume % of a branched aliphatic $C_5$–$C_6$ hydrocarbon, from about 2.0 to about 4.0 volume % of a branched $C_4$ aliphatic hydrocarbon, and no more than about 0.26 mL/L tetraethyl lead.

In another preferred embodiment, the aviation gasoline blend of the invention may desirably include from about 64.0 to about 70.0 volume % 2,2,4-trimethylpentane, from about 16.0 to about 20.0 volume % of a $C_7$–$C_{11}$ aromatic hydrocarbon, from about 10.5 to about 13.5 volume % of a branched aliphatic $C_5$–$C_6$ hydrocarbon, from about 2.5 to about 3.5 volume % of a branched $C_4$ aliphatic hydrocarbon, and no more than about 0.20 mL/L tetraethyl lead.

In yet another preferred embodiment, the aviation gasoline blend of the invention may desirably include about 67.0 volume % 2,2,4-trimethylpentane, about 18.0 volume % of a $C_7$–$C_{11}$ aromatic hydrocarbon, about 12.0 volume % of a branched aliphatic $C_5$–$C_6$ hydrocarbon, about 3.0 volume % of a branched $C_4$ aliphatic hydrocarbon, and no more than about 0.13 mL/L tetraethyl lead.

In a further preferred embodiment, the aviation gasoline blend of the invention may desirably include from about 56.0 to about 64.0 volume % 2,2,4-trimethylpentane, from about 13.0 to about 17.0 volume % of a $C_7$–$C_{11}$ aromatic hydrocarbon, from about 12.0 to about 16.0 volume % of an oxygenate, from about 6.5 to about 9.5 volume % of a branched aliphatic $C_5$–$C_6$ hydrocarbon, from about 2.0 to about 4.0 volume % of a branched $C_4$ aliphatic hydrocarbon, and no more than about 0.1 mL/L tetraethyl lead.

In a still further preferred embodiment, the aviation gasoline blend of the invention may desirably include from about 58.0 to about 62.0 volume % 2,2,4-trimethylpentane, from about 14.0 to about 16.0 volume % of a $C_7$–$C_{11}$ aromatic hydrocarbon, from about 13.0 to about 15.0 volume % of an oxygenate, from about 7.0 to about 9.0 volume % of a branched aliphatic $C_5$–$C_6$ hydrocarbon, from about 2.5 to about 3.5 volume % of a branched $C_4$ aliphatic hydrocarbon, and no more than about 0.07 mL/L tetraethyl lead.

In an additional preferred embodiment, the aviation gasoline blend of the invention may desirably include from about 58.0 to about 62.0 volume % 2,2,4-trimethylpentane, from about 14.0 to about 16.0 volume % of a $C_7$–$C_{11}$ aromatic hydrocarbon, from about 13.0 to about 15.0 volume % ofan oxygenate, from about 7.0 to about 9.0 volume % of a branched aliphatic $C_5$–$C_6$hydrocarbon, from about 2.5 to about 3.5 volume % of a branched $C_4$ aliphatic hydrocarbon, and no more than about 0.1 mL/L tetraethyl lead.

As is well known to those of ordinary skill in the art which pertains to the present invention, the blending of useful gasoline fuels, for either automobile or aviation use, is more an art than a science. Each component may provide a specific property or characteristic; however, when such a component is added to a blend it may tend to alter other necessary properties and characteristics. Accordingly, much trial and error is necessarily involved in order to achieve a blend which meets all of the criteria which have been preordained, such as, for example, by the ASTM D 910 specification. Thus, when one adds a component such as isooctane for the purpose of achieving a higher octane, the overall result may be that the vapor pressure becomes too low for the blend to be useful.

Although prior workers in the field have tried alkylates which contain a substantial isooctane portion, none have previously been successful. For example, SAE Technical Paper No. 971490 of J. N. Valentine et al., entitled "Developing a High Octane Unleaded Aviation Gasoline," presented during the General, Corporate & Regional Aviation Meeting & Exposition held at Wichita, Kans. on April 29 through May 1, 1999, describes certain experimental activities involving the testing of blends containing "a wide boiling range alkylate" in combination with an "octane boosting" component such as methyl-tertiary-butyl ether (MTBE) or ethyl-tertiary-butyl ether (ETBE). The wide boiling range alkylate included isooctane but the proportion thereof in the alkylate is not discussed. The final conclusion set forth by the authors was that "the experimental fuels blended for this program are not ready to be used in aircraft."

In accordance with one aspect of the present invention, the low lead aviation gasoline fuel blends provided thereby comply fully with all of the requirements of ASTM D 910. In accordance with another aspect of the invention, the low lead gasoline fuel blends incorporate an oxygenate, but otherwise comply fully with all of the requirements of ASTM D 910. In both cases these blends are ready to be used in aircraft.

In addition to the isooctane, the aviation gasoline blends of the invention preferably may include an aromatic component to increase supercharge rating and one or more lighter aliphatic hydrocarbons for distillation profile and RVP (Reid Vapor Pressure) control. The aromatic component may be a $C_7$–$C_{11}$ aromatic hydrocarbon and preferably may be xylene or toluene. The aliphatic hydrocarbon components ideally may be branched compounds and preferably may have 4 to 7 carbon atoms in their chains. Preferably the aliphatic hydrocarbon components may include a mixture of isopentane and isobutane. The isopentane primarily is useful for controlling the distillation profile while the isobutane is useful for adjusting both distillation profile and vapor pressure.

EXAMPLE I

A particularly useful aviation gasoline fuel blend which embodies the principles and concepts of the present invention is as follows:

| | |
|---|---|
| Isooctane (ASTM, Lot T-1304) | 67.0 volume % |
| Xylene (Exxon LSC34893, 9902/97388) | 18.0 volume % |
| Isopentane (SHRCO, 9811/96252) | 12.0 volume % |
| Isobutane (Instrument Orade, 99.5% min.) | 3.0 volume % |

A 1.5 liter batch of the foregoing was prepared and TEL was added to provide a final concentration of 0.47 mL/gal. The chemical and physical characteristics of the blend were tested and the results are set forth in TABLE 2.

TABLE 2

| | | |
|---|---|---|
| D 5191 | Vapor pressure | 48.6 kPa |
| D 3338 | Heat of combustion, net | 43.551 MJ/kg |
| D 5059 | Lead content | 0.13 mL/L |
| D 2700 | Motor octane number (MON) (BRE/30.2in/300F) | 101.8 |
| D 86 | Distillation, ° C., % evaporated | |
| | 10% | 70 |
| | 40% | 102 |
| | 50% | 103.5 |
| | 90% | 124.5 |
| | Final boiling point | 151.5 |
| | Sum of 10% + 50% evaporated | 173.5 |
| | Recovery | 98.5% |
| | Residue | 0.5% |
| | Loss | 1.0% |

A second three gallon blend of essentially the same composition, except that in this case the blend contained 0.5 mL/gal of TEL, was tested in accordance with ASTM D 909 and it was determined that the ASTM Supercharge rating (1.31 mL TEL/gal) performance number was 130.1.

As can be seen, the gasoline blend of EXAMPLE I complied fully with the criteria set forth in ASTM D 910. Moreover, it can be seen that the lead content of 0.13 mL/L is well below the specified maximum concentration of 0.53 mL/L. In fact, the lead concentration in the fuel of EXAMPLE I is only about 25% of the concentration allowed by the ASTM D 910 specification. Thus, the fuel of EXAMPLE I provides a 75% reduction in the lead concentration when compared with the amount allowed by ASTM D 910.

EXAMPLE II

Another highly useful aviation gasoline fuel blend which embodies the principles and concepts of the present invention is as follows:

| | |
|---|---|
| Isooctane (ASTM, Lot T-1304) | 60.0 volume % |
| Xylene (Exxon LSC34893, 9902/97388) | 15.0 volume % |
| Methyl t-butyl ether (Fisher Lot 980052, 99.9%) | 14.0 volume % |
| Isopentane (SHRCO, 9811/96252) | 8.0 volume % |
| Isobutane (Instrument Grade, 99.5% min.) | 3.0 volume % |

A batch of the foregoing was prepared and TEL was added to provide a final concentration of 0.2 mL/gal. The chemical and physical characteristics of the blend were tested and the results are set forth in TABLE 3.

TABLE 3

| | | |
|---|---|---|
| D 5191 | Vapor pressure | 48.3 kpa |
| D 909 | ASTM Supercharge rating | |
| | (1.31 mL TEL/gal) | |
| | Performance number | 130.4 |
| D 3338 | Heat of combustion, net | 43.581 MJ/kg |
| D 5059 | Lead content | 0.05 mL/L |
| D 2700 | Motor octane number (MON) (BRE/30.2in/300F) | 100.9 |
| D 86 | Distillation, ° C., % evaporated | |
| | 10% | 66.5 |
| | 40% | 94.5 |
| | 50% | 99.5 |
| | 90% | 119.5 |
| | Final boiling point | 150.0 |
| | Sum of 10% + 50% evaporated | 166.0 |
| | Recovery | 98.5% |
| | Residue | 0.7% |
| | Loss | 0.8% |

As can be seen, the gasoline blend of EXAMPLE II also complies filly with the criteria set forth in ASTM D 910 except for the fact that it includes an oxygenate. Moreover, it can be seen that the lead content of 0.05 mL/L is well below the specified maximum concentration of 0.53 mL/L. In fact, the lead concentration in the fuel of EXAMPLE II is only about 10% of the maximum lead concentration allowed by the ASTM D 910 specification. Thus, the fuel of EXAMPLE II provides a 90% reduction in the lead concentration when compared with the amount allowed by ASTM D 910.

A purified isooctane for use in blending the aviation gasoline of the invention may preferably be obtained by fractionation and hydrogenation of crude diisobutylene (DIB). Crude DIB having chemical and physical characteristics as set forth in TABLE 4 may be used as a starting material.

TABLE 4

| | | | | | |
|---|---|---|---|---|---|
| D 5191 | Vapor pressure, DVPE (40 CFR 80) | | | | 1.78 psi |
| D 358 | Solubility in water, 25° C. | | | | 63 vol ppm |
| D 2699 | Research octane number (RON) (BRE/30.lin/127F) | | | | 103.1 |
| D 2700 | Motor octane number (MON) (BRB/30.lin/300F) | | | | 86.0 |
| D 5134 | Hydrocarbon components | | | | Mass % |
| | 2,4,4-trimethyl-1-pentene | | | | 70.46 |
| | 2,4,4-trimethyl-2-pentene | | | | 19.42 |
| | 4,4-dimethyl-2-neo-pentyl-1-pentene | | | | 3.14 |
| | 2,2,4,6,6-pentamethyl-3-heptene | | | | 3.65 |
| | Other diisobutylene isomers | | | | 0.47 |
| | Other triisobutylene isomers | | | | 2.81 |
| | Unidentified | | | | 0.05 |
| D 86 | Distillation, ° F., % evaporated | | | | |
| | IBP | 212 | 70% | 224 | |
| | 5% | 214 | 80% | 230 | |
| | 10% | 214 | 90% | 261 | |
| | 20% | 215 | 95% | 346 | |
| | 30% | 216 | End | 380 | |
| | 40% | 217 | Recovery | | 99.0% |
| | 50% | 219 | Residue | | 1.0% |
| | 60% | 222 | Loss | | 0.0% |

The crude DIB from TABLE 4 may be subjected to conventional fractionation so as to obtain a finished DIB having chemical and physical characteristics as set forth in TABLE 5.

TABLE 5

| | | | | | |
|---|---|---|---|---|---|
| D 5191 | Vapor pressure, DVPE (40 CFR 80) | | | | 1.85 psi |
| D 358 | Solubility in water, 25° C. | | | | 45 vol ppm |
| D 5134 | Hydrocarbon components | | | | Mass % |
| | 2,4,4-trimethyl-1-pentene | | | | 79.55 |
| | 2,4,4-trimethyl-2-pentene | | | | 19.87 |
| | Other diisobutylene isomers | | | | 0.33 |
| | Unidentified | | | | 0.25 |
| D 86 | Distillation, ° F., % evaporated | | | | |
| | IBP | 211 | | | |
| | 5% | 212 | 80% | 213 | |
| | 10% | 212 | 90% | 213 | |
| | 20% | 212 | 95% | 213 | |
| | 30% | 212 | End | 237 | |
| | 40% | 213 | | | |
| | 50% | 213 | Recovery | | 99.0% |
| | 60% | 213 | Residue | | 0.6% |
| | 70% | 213 | Loss | | 0.4% |

The finished DIB of TABLE 5 may be subjected to conventional hydrogenation processing so as to obtain a purified isooctane product containing a very high concentration of isooctane and having the physical and chemical characteristics as shown in TABLE 6.

TABLE 6

| | | | | | |
|---|---|---|---|---|---|
| D 5191 | Vapor pressure, DVPE (40 CFR 80) | | | | 2.14 psi |
| D 358 | Solubility in water, 25° C. | | | | 48 vol ppm |
| D 5134 | Hydrocarbon components | | | | Mass % |
| | 2-methylhexane | | | | 0.02 |
| | 2,2,4-trimethylpentane | | | | 99.54 |
| | 1,1,3-trimethylcyclopentane | | | | 0.06 |
| | 2,2,3-trimethylpentane | | | | 0.07 |
| | 2,3,4-trimethylpentane | | | | 0.22 |
| | Toluene | | | | 0.01 |
| | 2-methylheptane | | | | 0.03 |
| | n-octane | | | | 0.02 |
| | 2,2,5-trimethylhexane | | | | 0.03 |
| D 86 | Distillation, ° F., % evaporated | | | | |
| | IBP | 205 | | | |
| | 5% | 207 | 80% | 208 | |
| | 10% | 207 | 90% | 208 | |
| | 20% | 207 | 95% | 209 | |
| | 30% | 207 | End | 231 | |
| | 40% | 207 | | | |
| | 50% | 208 | Recovery | | 99.0% |
| | 60% | 208 | Residue | | 0.6% |
| | 70% | 208 | Loss | | 0.4% |

An objective of the processing described above is to provide a purified isooctane material which may have a D 86 Distillation end point no greater than about 337° F., preferably no greater than about 320° F., more preferably no greater than about 250° F., and which even more preferably may be as low as 230° F. The clear effort here is to obtain an isooctane material having a D 86 Distillation end point which approaches, as nearly as possible, the atmospheric boiling point of pure isooctane. A major limiting factor may simply be the cost of producing the purified isooctane material. Suffice it to say, the purer the better from a strict performance viewpoint; however, to keep overall costs low for commercial purposes, a purity of at least about 95 weight % may be useful in accordance with the invention to provide an appropriate D 86 Distillation end point. A purified isooctane material is desirable in accordance with the principles and concepts of the invention so that the properties ofan aviation gasoline prepared therefrom are more easily controlled.

It should be noted that the process steps described above could be reversed. That is to say, the crude DIB of TABLE 4 could first be hydrogenated to produce a crude isooctane containing product blend having the physical and chemical characteristics described in TABLE 7.

TABLE 7

| | | | | | |
|---|---|---|---|---|---|
| D 5191 | Vapor pressure, DVPE (40 CFR 80) | | | | 1.94 psi |
| D 3120 | Sulfur content | | | | <1 ppm |
| D 358 | Solubility in water, 25° C. | | | | 46 vol ppm |
| D 2699 | Research octane number (RON) (BRE/30.5in/133F) | | | | 100.5 |
| D 2700 | Motor octane number (MON) (BRE/30.5in/300F) | | | | 99.4 |
| D 5134 | Hydrocarbon components | | | | Mass % |
| | 2,2,4-trimethylpentane | | | | 87.67 |
| | Methylcyclohexane | | | | 0.58 |
| | Ethylcyclohexane | | | | 0.04 |
| | 2,2,3-trimethylpentane | | | | 0.16 |
| | 1-trans-2-cis-4-trimethylcyclopentane | | | | 0.06 |
| | 2,3 -dimethylhexane | | | | 0.38 |
| | cis-1,3-dimethylcyclohexane | | | | 0.03 |
| | n-nonane | | | | 0.09 |
| | 2,2,4,6,6-pentamethylheptane | | | | 7.23 |
| | Other C12 paraffins | | | | 3.76 |
| D 86 | Distillation, ° F., % evaporated | | | | |
| | IBP | 207 | | | |
| | 5% | 209 | 80% | 226 | |
| | 10% | 209 | 90% | 262 | |
| | 20% | 210 | 95% | 347 | |
| | 30% | 211 | End | 389 | |
| | 40% | 213 | | | |
| | 50% | 214 | Recovery | | 98.6% |
| | 60% | 216 | Residue | | 1.3% |
| | 70% | 219 | Loss | | 0.1% |

The crude isooctane blend of TABLE 7 may be fractionated using conventional techniques to produce a purified isooctane blend which is essentially the same as the purified isooctane blend described above in TABLE 6.

No matter how it is produced, a purified isooctane material as described in TABLE 6 is a supurb isooctane material for use in connection with the present invention. This material may be blended with the other ingredients discussed above to provide an excellent low lead aviation gasoline. The high purity of the isooctane facilitates control of the properties of an aviation gasoline prepared therefrom. Thus, the purified isooctane material of TABLE 6 may be used to prepare either the fuel of EXAMPLE I or the fuel of EXAMPLE II.

We claim:

1. An aviation gasoline blend which satisfies the requirements of ASTM D 910, contains less than 0.53 mL/L of lead and comprises at least 50.0 volume % 2,2,4-trimethylpentane.

2. A gasoline blend as set forth in claim 1 which contains no more than 0.26 mL/L of said lead and comprises from about 62.0 to about 72.0 volume % of said 2,2,4-trimethylpentane.

3. A gasoline blend as set forth in claim 2 which comprises from about 65.0 to about 69.0 volume % of said 2,2,4-trimethylpentane.

4. A gasoline blend as set forth in claim 3 which comprises about 67.0 volume % of said 2,2,4-trimethylpentane.

5. A gasoline blend as set forth in claim 1 which comprises no more than about 85.0 volume % of said 2,2,4-trimethylpentane.

6. A gasoline blend as set forth in claim 5 which contains from about 0.11 to about 0.15 mL/L of said lead.

7. A gasoline blend as set forth in claim 5 which contains from about 0.12 to about 0.14 mL/L of said lead.

8. A gasoline blend as set forth in claim 5 which contains about 0.13 mL/L of said lead.

9. A gasoline blend as set forth in claim 5 which contains no more than about 0.13 mL/L of said lead.

10. A gasoline blend as set forth in claim 5 which comprises at least about 67.0 volume % of said 2,2,4-trimethylpentane.

11. A gasoline blend as set forth in claim 10 which contains no more than about 0.13 mL/L of said lead.

12. A gasoline blend as set forth in claim 1 which comprises a $C_7$–$C_{11}$ aromatic hydrocarbon, a $C_5$–$C_6$ aliphatic hydrocarbon and a $C_4$ aliphatic hydrocarbon.

13. A gasoline blend as set forth in claim 1, wherein is included a sufficient amount of a $C_7$–$C_{11}$ aromatic hydrocarbon to provide an appropriate supercharge rating.

14. A gasoline blend as set forth in claim 1, wherein is included a sufficient amount of a $C_5$–$C_6$ aliphatic hydrocarbon to provide D-86 distillation control.

15. A gasoline blend as set forth in claim 1, wherein is included a sufficient amount of a $C_4$ aliphatic hydrocarbon to provide D-86 distillation and RVP control.

16. A gasoline blend as set forth in claim 13, wherein is included a sufficient amount of a $C_5$–$C_6$ aliphatic hydrocarbon to provide D-86 distillation control.

17. A gasoline blend as set forth in claim 13, wherein is included a sufficient amount of a $C_4$ aliphatic hydrocarbon to provide D-86 distillation and RVP control.

18. A gasoline blend as set forth in claim 14, wherein is included a sufficient amount of a $C_4$ aliphatic hydrocarbon to provide D-86 distillation and RVP control.

19. A gasoline blend as set forth in claim 16, wherein is included a sufficient amount of a $C_4$ aliphatic hydrocarbon to provide D-86 distillation and RVP control.

20. A gasoline blend as set forth in claim 1 which includes from about 62.0 to about 72.0 volume % 2,2,4-trimethylpentane, from about 15.0 to about 21.0 volume % xylene, from about 10.0 to about 14.0 volume % isopentane, from about 2.0 to about 4.0 volume % isobutane and no more than about 0.26 mL/L tetraethyl lead.

21. A gasoline blend as set forth in claim 1 which includes from about 64.0 to about 70.0 volume % 2,2,4-trimethylpentane, from about 16.0 to about 20.0 volume % xylene, from about 10.5 to about 13.5 volume % isopentane, from about 2.5 to about 3.5 volume % isobutane and no more than about 0.20 mL/L tetraethyl lead.

22. A gasoline blend as set forth in claim 1 which includes about 67.0 volume % 2,2,4-trimethylpentane, about 18.0 volume % xylene, about 12.0 volume % isopentane, about 3.0 volume % isobutane and no more than about 0.13 mL/L tetraethyl lead.

23. A gasoline blend as set forth in claim 1 which includes from about 62.0 to about 72.0 volume % 2,2,4-trimethylpentane, from about 15.0 to about 21.0 volume % of a $C_7$–$C_{11}$ aromatic hydrocarbon, from about 10.0 to about 14.0 volume % of a branched aliphatic $C_5$–$C_6$ hydrocarbon, from about 2.0 to about 4.0 volume % of a branched $C_4$ aliphatic hydrocarbon and no more than about 0.26 mL/L tetraethyl lead.

24. A gasoline blend as set forth in claim 1 which includes from about 64.0 to about 70.0 volume % 2,2,4-trimethylpentane, from about 16.0 to about 20.0 volume % of a $C_7$–$C_{11}$ aromatic hydrocarbon, from about 10.5 to about 13.5 volume % of a branched aliphatic $C_5$–$C_6$ hydrocarbon, from about 2.5 to about 3.5 volume % of a branched $C_4$ aliphatic hydrocarbon and no more than about 0.20 mL/L tetraethyl lead.

25. A gasoline blend as set forth in claim 1 which includes about 67.0 volume % 2,2,4-trimethylpentane, about 18.0 volume % of a $C_7$–$C_{11}$ aromatic hydrocarbon, about 12.0 volume % of a branched aliphatic $C_5$–$C_6$ hydrocarbon, about 3.0 volume % of a branched $C_4$ aliphatic hydrocarbon and no more than about 0.13 mL/L tetraethyl lead.

26. An oxygenated aviation gasoline blend which deviates from the requirements of ASTM D 910 only in that it includes an oxygenate, which contains less than 0.53 mL/L of lead and which comprises at least 50.0 volume % 2,2,4-trimethylpentane.

27. A gasoline blend as set forth in claim 26 which contains no more than 0.26 mL/L of said lead and comprises from about 55.0 to about 65.0 volume % of said 2,2,4-trimethylpentane.

28. A gasoline blend as set forth in claim 27 which comprises from about 58.0 to about 62.0 volume % of said 2,2,4-trimethylpentane.

29. A gasoline blend as set forth in claim 28 which comprises about 60.0 volume % of said 2,2,4-trimethylpentane.

30. A gasoline blend as set forth in claim 26 which comprises no more than about 85.0 volume % of said 2,2,4-trimethylpentane.

31. A gasoline blend as set forth in claim 30 which contains from about 0.03 to about 0.07 mL/L of said lead.

32. A gasoline blend as set forth in claim 31 which contains from about 0.04 to about 0.06 mL/L of said lead.

33. A gasoline blend as set forth in claim 32 which contains about 0.05 mL/L of said lead.

34. A gasoline blend as set forth in claim 30 which contains no more than about 0.05 mL/L of said lead.

35. A gasoline blend as set forth in claim 30 which comprises at least about 67.0 volume % of said 2,2,4-trimethylpentane.

36. A gasoline blend as set forth in claim 35 which contains no more than about 0.13 mL/L of said lead.

37. A gasoline blend as set forth in claim 26 which comprises a $C_7$–$C_{11}$ aromatic hydrocarbon, a $C_5$–$C_6$ aliphatic hydrocarbon and a $C_4$ aliphatic hydrocarbon.

38. A gasoline blend as set forth in claim 26, wherein is included a sufficient amount of a $C_7$–$C_{11}$ aromatic hydrocarbon to provide an appropriate supercharge rating.

39. A gasoline blend as set forth in claim 26, wherein is included a sufficient amount of a $C_5$–$C_6$ aliphatic hydrocarbon to provide D-86 distillation control.

40. A gasoline blend as set forth in claim 26, wherein is included a sufficient amount of a $C_4$ aliphatic hydrocarbon to provide D-86 distillation and RVP control.

41. A gasoline blend as set forth in claim 37, wherein is included a sufficient amount of a $C_5$–$C_6$ aliphatic hydrocarbon to provide D-86 distillation control.

42. A gasoline blend as set forth in claim 37, wherein is included a sufficient amount of a $C_4$ aliphatic hydrocarbon to provide D-86 distillation and RVP control.

43. A gasoline blend as set forth in claim 38, wherein is included a sufficient amount of a $C_4$ aliphatic hydrocarbon to provide D-86 distillation and RVP control.

44. A gasoline blend as set forth in claim 40, wherein is included a sufficient amount of a $C_4$ aliphatic hydrocarbon to provide D-86 distillation and RVP control.

45. A gasoline blend as set forth in claim 26 which includes from about 56.0 to about 64.0 volume % 2,2,4-trimethylpentane, from about 13.0 to about 17.0 volume % xylene, from about 12.0 to about 16.0 volume % methyl t-butyl ether, from about 6.5 to about 9.5 volume % isopentane, from about 2.0 to about 4.0 volume % isobutane and no more than about 0.1 mL/L tetraethyl lead.

46. A gasoline blend as set forth in claim 26 which includes from about 58.0 to about 62.0 volume % 2,2,4-trimethylpentane, from about 14.0 to about 16.0 volume % xylene, from about 13.0 to about 15.0 volume % methyl t-butyl ether, from about 7.0 to about 9.0 volume % isopentane, from about 2.5 to about 3.5 volume % isobutane and no more than about 0.07 mL/L tetraethyl lead.

47. A gasoline blend as set forth in claim 26 which includes about 60.0 volume % 2,2,4-trimethylpentane, about 15.0 volume % xylene, about 14.0 volume % methyl t-butyl ether, about 8.0 volume % isopentane, about 3.0 volume % isobutane and no more than about 0.05 mL/L tetraethyl lead.

48. A gasoline blend as set forth in claim 26 which includes from about 56.0 to about 64.0 volume % 2,2,4-trimethylpentane, from about 13.0 to about 17.0 volume % of a $C_7$–$C_{11}$ aromatic hydrocarbon, from about 12.0 to about 16.0 volume % of an oxygenate, from about 6.5 to about 9.5 volume % of a branched aliphatic $C_5$–$C_6$ hydrocarbon, from about 2.0 to about 4.0 volume % of a branched $C_4$ aliphatic hydrocarbon and no more than about 0.1 mL/L tetraethyl lead.

49. A gasoline blend as set forth in claim 26 which includes from about 58.0 to about 62.0 volume % 2,2,4-trimethylpentane, from about 14.0 to about 16.0 volume % of a $C_7$–$C_{11}$ aromatic hydrocarbon, from about 13.0 to about 15.0 volume % of an oxygenate, from about 7.0 to about 9.0 volume % of a branched aliphatic $C_5$–$C_6$ hydrocarbon, from about 2.5 to about 3.5 volume % of a branched $C_4$ aliphatic hydrocarbon and no more than about 0.07 mL/L tetraethyl lead.

50. A gasoline blend as set forth in claim 26 which includes from about 58.0 to about 62.0 volume % 2,2,4-trimethylpentane, from about 14.0 to about 16.0 volume % of a $C_7$–$C_{11}$ aromatic hydrocarbon, from about 13.0 to about 15.0 volume % of an oxygenate, from about 7.0 to about 9.0 volume % of a branched aliphatic $C_5$–$C_6$ hydrocarbon, from about 2.5 to about 3.5 volume % of a branched $C_4$ aliphatic hydrocarbon and no more than about 0.1 mL/L tetraethyl lead.

51. An aviation gasoline blend which satisfies the requirements of ASTM D 910, which contains less than 0.26 mL/L of lead and which comprises a sufficient amount of 2,2,4-trimethylpentane to provide said blend with a motor octane number of no less than 99.5.

52. An oxygenated aviation gasoline blend which 910 only in the inclusion of an oxygenate, which contains no more than 0.26 mL/L of lead and which comprises a sufficient amount of 2,2,4-trimethylpentane to provide said blend with a motor octane number of no less than 99.5.

* * * * *